US010410773B2

(12) United States Patent
Rowe

(10) Patent No.: US 10,410,773 B2
(45) Date of Patent: Sep. 10, 2019

(54) SYNTHESIS AND ANNEALING OF MANGANESE BISMUTH NANOPARTICLES

(71) Applicant: Toyota Motor Engineering & Manufacturing North America, Inc., Erlanger, KY (US)

(72) Inventor: Michael Paul Rowe, Pinckney, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 673 days.

(21) Appl. No.: 14/025,033

(22) Filed: Sep. 12, 2013

(65) Prior Publication Data

US 2015/0068646 A1 Mar. 12, 2015

(51) Int. Cl.

| | |
|---|---|
| ***H01F 1/01*** | (2006.01) |
| ***H01F 41/24*** | (2006.01) |
| ***H01F 1/047*** | (2006.01) |
| ***B22F 9/20*** | (2006.01) |
| ***H01F 1/06*** | (2006.01) |

(Continued)

(52) U.S. Cl.

CPC ..... *H01F 1/047* (2013.01); *B22F 1/0018* (2013.01); *B22F 1/0085* (2013.01); *B22F 9/20* (2013.01); *C22C 12/00* (2013.01); *C22C 22/00* (2013.01); *H01F 1/065* (2013.01);

(Continued)

(58) Field of Classification Search

CPC . H01F 1/047; H01F 1/06; H01F 1/065; H01F 1/0054; H01F 1/01; H01F 1/04; H01F 41/24; H01F 7/02; H01F 1/0045; B22F 2999/00; B22F 1/0018; B22F 1/02; B22F 1/025; B22F 2202/05; B22F 9/24; B22F 1/0085; B22F 2304/054; B22F 2304/056; B22F 9/20; C01G 49/009; C01P 2004/62; C01P 2004/64; C01P 2006/42;

(Continued)

(56) References Cited

U.S. PATENT DOCUMENTS 5,456,986 A 10/1995 Majetich et al.
5,648,160 A 7/1997 Kishimoto et al.

(Continued)

FOREIGN PATENT DOCUMENTS

JP H09-139304 A 5/1997
JP 2003-277803 A 10/2003

(Continued)

OTHER PUBLICATIONS

J. B. Yang, et al., "Anisotropic Nanocrystalline MnBi with High Coercivity at High Temperature" Applied Physics Letters 99, 082505 (2011), (pp. 082505-1-082505-3).

(Continued)

*Primary Examiner* — Shuangyi Abu Ali

(74) *Attorney, Agent, or Firm* — Oblon, McClelland, Maier & Neustadt, L.L.P.

(57) ABSTRACT

The claimed invention provides a wet chemical method to prepare manganese bismuth nanoparticles having a particle diameter of 5 to 200 nm. When annealed at 550 to 600K in a field of 0 to 3 T the nanoparticles exhibit a coercivity of approximately 1 T and are suitable for utility as a permanent magnet material. A permanent magnet containing the annealed MnBi nanoparticles is also provided.

3 Claims, 5 Drawing Sheets

(51) Int. Cl.

| | |
|---|---|
| ***B22F 1/00*** | (2006.01) |
| ***C22C 12/00*** | (2006.01) |
| ***C22C 22/00*** | (2006.01) |
| *H01F 1/00* | (2006.01) |

(52) U.S. Cl.
CPC ... *B22F 2304/054* (2013.01); *B22F 2304/056* (2013.01); *C22C 2202/02* (2013.01); *H01F 1/0045* (2013.01)

(58) Field of Classification Search
CPC ..... Y10T 428/12028; Y10T 428/2993; C22C 12/00; C22C 2202/02; C22C 22/00
See application file for complete search history.

(56) References Cited

U.S. PATENT DOCUMENTS

| | | | | |
|---|---|---|---|---|
| 6,143,096 | A | 11/2000 | Kitahata et al. | |
| 2010/0215851 | A1 | 8/2010 | Shoji et al. | |
| 2010/0218858 | A1 | 9/2010 | Baker et al. | |
| 2012/0208026 | A1* | 8/2012 | Zhou et al. | 428/404 |
| 2012/0236092 | A1 | 9/2012 | Iftime et al. | |

FOREIGN PATENT DOCUMENTS

| | | | |
|---|---|---|---|
| JP | 2006-278470 | A | 10/2006 |
| JP | 2007-318149 | A | 12/2007 |

OTHER PUBLICATIONS

Y. B. Yang, et al., "Temperature Dependences of Structure and Coercivity for Melt-Spun MnBi Compound" Journal of Magnetism and Magnetic Materials, 330 (2013), (pp. 106-110).
K. Suzuki, et al., Spin Reorientation Transition and Hard Magnetic Properties of MnBi Intermetallic Compound, Journal of Applied Physics 111, 07E303 (2012), (pp. 07E203-1-07E303-3).
First Office Action dated Jul. 19, 2017 in Chinese Patent Application No. 201410392522.0 with English translation.
Office Action dated Jun. 5, 2018 in connection with JP Patent Application No. 2014-177014.
Office Action dated Mar. 2, 2018 in Chinese Patent Application No. 201410392522.0 (with English language translation).
Notification of the Third Office Action dated Sep. 14, 2018 in connection with Chinese Patent Application No. 201410392522.0 with English translation.

* cited by examiner

SYNTHESIS AND ANNEALING OF MANGANESE BISMUTH NANOPARTICLES

BACKGROUND OF THE INVENTION

This invention is related to the synthesis and preparation of novel materials for use as strong permanent hard magnets. Many of today's advancing technologies require an efficient and strong hard magnet as a basic component of the device structure. Such devices range from cellular phones to high performance electric motors and significant effort is ongoing throughout the industry to find materials which not only meet current requirements, but also ever increasing demand for efficient, less expensive and easily produced hard magnet materials.

Conventionally, neodymium iron borate is generally recognized as one of the strongest, best performing hard magnet materials available. However, because this material is based on the rare earth element neodymium, it is expensive and often the available supply is not stable. Accordingly, there is a need for a material which performs equally or better than neodymium iron borate as a hard magnet but which is based on readily available and less expensive component materials.

Of various candidate materials under evaluation as a neodymium iron borate replacement, manganese bismuth alloy nanoparticles (MnBi) have been identified as a material of great interest.

Yang et al. (Applied Physics Letters, 99 082502 (2011)) and (Journal of Magnetism and Magnetic Materials, 330 (2013) 106-110) attributes many advantageous performance properties to low temperature phase manganese bismuth nanoparticles and describes the preparation of the MnBi nanoparticles by a melt spinning and annealing method. MnBi ingots were prepared by arc-melting and the ingot material was melted and the melt ejected onto the surface of a rotating copper wheel. After annealing, the obtained MnBi ribbons were ground to a powder having single crystal-like grains of a size of as little as 20-30 nm observed in the TEM image of the annealed. MnBi.

Suzuki et al. (Journal of Applied Physics 111, 07E303 (2012)) describe a study of the effect of mechanical grinding on the spin reorientation transition temperature ($T_{SR}$) of MnBi prepared by melt spinning and annealing.

Iftime et al. (US 2012/0236092) describes core shell metal nanoparticles as a component of a phase change magnetic ink. MnBi is included as an example of a suitable core metal material. Preparation of such material is described in general as ball-milling attrition followed by annealing to effect crystallization of the amorphous milled product. No explicit description of the preparation of Mn Bi nanoparticles is provided and the Examples describe cobalt nanoparticle cores and iron nanoparticle cores.

Baker et al. (US 2010/0218858) describes permanent magnets of nanostructured Mn—Al and Mn—Al—C alloys. The nanoparticles are prepared by mechanical milling of the alloy metal and the resulting milled material is annealed. The initial alloy is prepared by melting a metal mixture and then quenching the melt, Shoji et al. (US 2010/0215851) describes a method to produce core-shell composite nano-particles wherein the core particles are heated in advance of shell application. MnBi is listed as an example of a magnetic nanoparticle material. Although formation by a chemical synthesis method is indicated, no specific description of preparation of any alloy is provided.

Kitahata et al. (U.S. Pat. No. 6,143,096) describes a method to prepare a powder form Mn—Bi alloy wherein the raw materials are mixed and heated to a temperature higher than the melting points of the components; the powder obtained is thermally treated and then wet milled to obtain a powder having a particle diameter of less than 5 μm.

Kishimoto et al. (U.S. Pat. No. 5,648,160) describes a method for producing an MnBi powder wherein a Mn powder and a Bi powder are mixed. Both powders have a particle size of 50 to 300 mesh. The mixture is press molded and then thermally treated in a non-oxidizing or reducing atmosphere at a temperature not higher than the melting point of Bi. The Mn—Bi ingot is then ground to a particle size of from 0.1 to 20 μm.

Majetich et al. (U.S. Pat. No. 5,456,986) describes carbon coated Mn—Bi nanoparticles having a diameter of from 5 to 60 nm obtained by a carbon arc decomposition of graphite rods which are packed with manganese and bismuth.

None of these references describe or suggest a simple wet chemical method for the synthesis of MnBi nanoparticles having a particle size which is less than 20 nm. It is therefore an object of the present invention to provide a wet synthesis method to produce MnBi nanoparticles having a particle size of 20 nm or less.

It is a further object of the present invention to provide MnBi nanoparticles of the low temperature phase having a particle size of 20 nm or less.

SUMMARY OF THE INVENTION

These and other objects have been achieved according to the present invention, the first embodiment of which includes a method to prepare a manganese-bismuth alloy nanoparticle, comprising: treating Mn powder with a hydride reducing agent in an ether solvent with agitation;

adding a solution of a bismuth salt of a long chain carboxylate to the Mn-hydride reducing agent mixture while continuing the agitation;

upon completion of the bismuth salt solution addition, adding a an organic amine while continuing the agitation; and continuing agitation to form aggregated MnBi nanoparticles.

In an embodiment of the present invention, the hydride treatment comprises treatment at 20-25° C. for 10 to 48 hours followed by treatment at 50 to 70° C. for 10 to 48 hours.

In one specific embodiment of the present invention the hydride reducing agent is lithium borohydride and in a further an equivalent ratio of hydride to Mn is from 1/1 to 100/1.

In another embodiment, the present invention provides a MnBi nanoparticle having a particle size of 5 to 200 nm and a coercivity of approximately 1 T, wherein the nanoparticle is prepared according to the method of any of the above embodiments and further annealed at 600K in a 3 T field.

In an application embodiment, the present invention provides a hard magnet comprising a plurality of MnBi nanoparticles having a particle size of 5 to 200 nm and a coercivity of approximately 1 T.

The above description is intended to provide a summary overview of the present invention and is not intended to be limiting. One of ordinary skill in the art will readily recognize various modifications of the above as well as the detailed description and Claims which follow. All such modifications are considered within the scope of the present invention.

Throughout this description all ranges described include all values and sub-ranges therein, unless otherwise specified. Additionally, the indefinite article "a" or "an" carries the meaning of "one or more" throughout the description, unless otherwise specified.

DETAILED DESCRIPTION OF THE PREFERRED EMBODIMENTS

Figure 1:
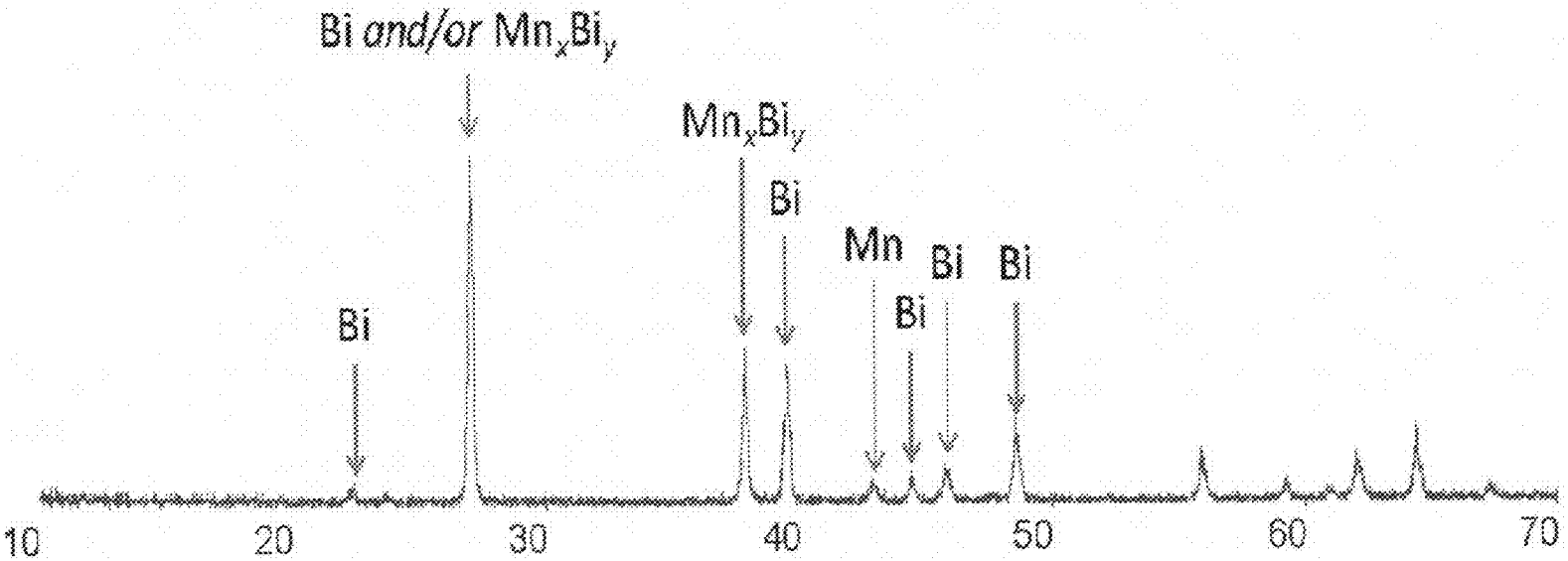
FIG. 1 shows the XRD spectrum of MnBi nanoparticles prepared in Example 1.

In an ongoing study of magnetic materials and particularly nanoparticle magnetic materials, the present inventor has identified manganese bismuth alloy in a nanoparticle form as a material having potential utility as a replacement of neodymium iron borate for manufacture of permanent magnets. MnBi nanoparticles are predicted to express coercivities as high as 4 T. When combined with a soft magnetic nanoparticle matrix, the resulting nanocomposite should yield a rare-earth-element-free alternative to the standard neodymium iron borate permanent magnet.

Conventionally, MnBi nanoparticles have been prepared from a top-down ball milling of MnBi ingots. However, the top-down ball milling of MnBi ingots has shown the limitation of not yielding nanoparticles smaller than 20 nm, just short of the ideal 7 nm nanoparticle diameter. In order to produce nanoparticles having a consistently smaller size than those obtained in a milling process, the inventor has studied nanoparticle wet syntheses, and has discovered the method described in the present invention. Further, the inventor has discovered that annealing treatment of the wet synthesis obtained MnBi nanoparticles results in a material which is equal in performance to neodymium iron borate as a hard magnetic composition. MnBi nanoparticles are predicted to express coercivities as high as 4 T and therefore, when combined with a soft magnetic nanoparticle matrix, the resulting nanocomposite should yield a rare-earth-element-free alternative to the standard neodymium iron borate permanent magnet.

In the first embodiment the present invention provides a method to prepare a manganese-bismuth alloy nanoparticle, comprising: treating Mn powder with a hydride reducing agent in an ether solvent with agitation; adding a solution of a bismuth salt of a long chain carboxylate to the Mn-hydride reducing agent mixture while continuing the agitation; upon completion of the bismuth salt solution addition, adding a an organic amine while continuing the agitation; and continuing agitation to form aggregated MnBi nanoparticles.

The ether solvent for the hydride treatment may be any ether compatible with hydride reaction conditions. Suitable ether solvents include tetrahydrofuran (THF), 2-methyltetrahydrofuran, diethyl ether, diisopropyl ether, 1,4-dioxane, dimethoxy ethane, diethylene glycol diethylether, 2-(2-methoxyethoxy)ethanol and methyl tert-butyl ether. THF may be a preferred solvent.

The hydride reducing agent may be any material capable of reacting with the manganese and include NaH, LiH, $CaH_2$, $LiAlH_4$ and $LiBH_4$. $LiBH_4$ may be a preferred hydride treatment agent.

The hydride treatment comprises at least two stages wherein in an initial stage the mixture is stirred at 20-25° C. for 10 to 48 hours followed by a second stage of treatment at 50 to 70° C. for 10 to 48 hours. Variations of these stages may be optimized to appropriately modify the properties such as size and structure of the nanoparticles obtained as would be understood by one of ordinary skill in the art.

Additionally, the amount of hydride treatment agent may be varied to modify conditions and the properties of the nanoparticles obtained and may vary in an equivalent ratio of hydride to Mn of from 1/1 to 100/1.

The bismuth may be added in any ether soluble salt form and is preferably added as a salt of a long chain carboxylic acid. In a preferred embodiment, the Bi is added as bismuth neodecanoate. The mole ratio of Bi to Mn may vary from 0.8/1 to 1.2/1. Preferably the ratio of Bi/Mn is from 0.9/1 to 1.1/1 and most preferably, the ratio of Bi/Mn is 1/1. The addition time of the bismuth compound may be varied to optimize and modify the properties of the MnBi nanoparticles. Preferably the addition time is less than one hour and in a preferred embodiment the addition time is about 20 minutes.

Upon completion of the addition of the bismuth compound, an organic amine, preferably a primary amine having a carbon chain of from 6 to 12 carbons is added to the alloy reaction mixture to precipitate and aggregate the MnBi nanoparticles. The resulting solids may be removed from the reaction mother liquor and washed free of soluble impurities with water.

XRD analysis (FIG. 1) of the nanoparticles obtained by the wet chemical synthesis according to the present invention indicates the MnBi nanoparticles have a particle diameter of 30 nm or less. This particle size is verified by FE-SEM microscopy (FIGS. 2*a* and 2*b*) which also corroborates that the Mn powder is consumed in the synthesis process.

Figure 3:
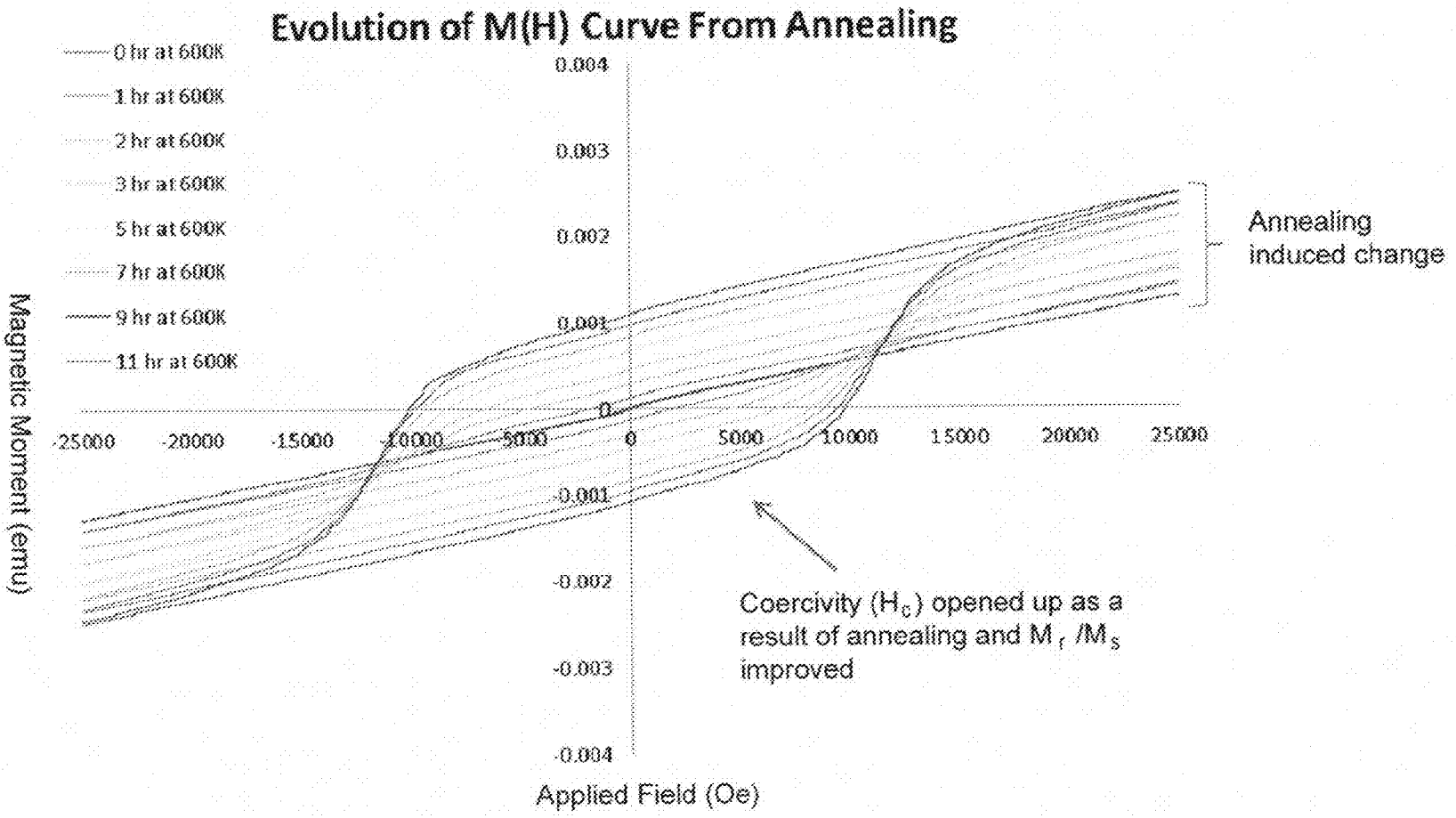
FIG. 3 shows the M(H) curves over the course of annealing the MnBi nanoparticles prepared in Example 1 at 600 K and under a 3 T applied field.

The as-synthesized MnBi nanoparticles have relatively weak magnetic saturation ($M_s$) and coercivity ($H_c$). However, the inventor has discovered that annealing the nanoparticles at 600 K, in a 3 T field, produced improvement to both the magnetic saturation ($M_s$) and coercivity ($H_c$). $M_s$ is the point where application of an even stronger magnetic field will not make the material being magnetized any more magnetic. Thus, $M_s$ is the maximum point where a material can be magnetized no more. Magnetic remanence ($M_r$) is the residual magnetization of a material remaining after a secondary/exterior magnetic field is applied and then removed. The smaller the $M_r/M_s$ is for a magnetic material, the greater the oscillation in electric motor performance engineers must struggle with. Ideally in such applications, the $M_r/M_s$ for hard magnetic materials like MnBi would be as large as possible. Thus the inventor has determined that $M_r/M_s$ may be improved with this annealing protocol. $H_c$ values of approximately 1 T were measured, with an $M_r/M_s$ ratio of 45% (FIG. 3).

Thus, in another embodiment, the present invention provides a MnBi nanoparticle having a particle size of 5 to 200 nm and a coercivity of approximately 1 T, wherein the nanoparticle is prepared according to the method described above and further annealed.

Figure 4:
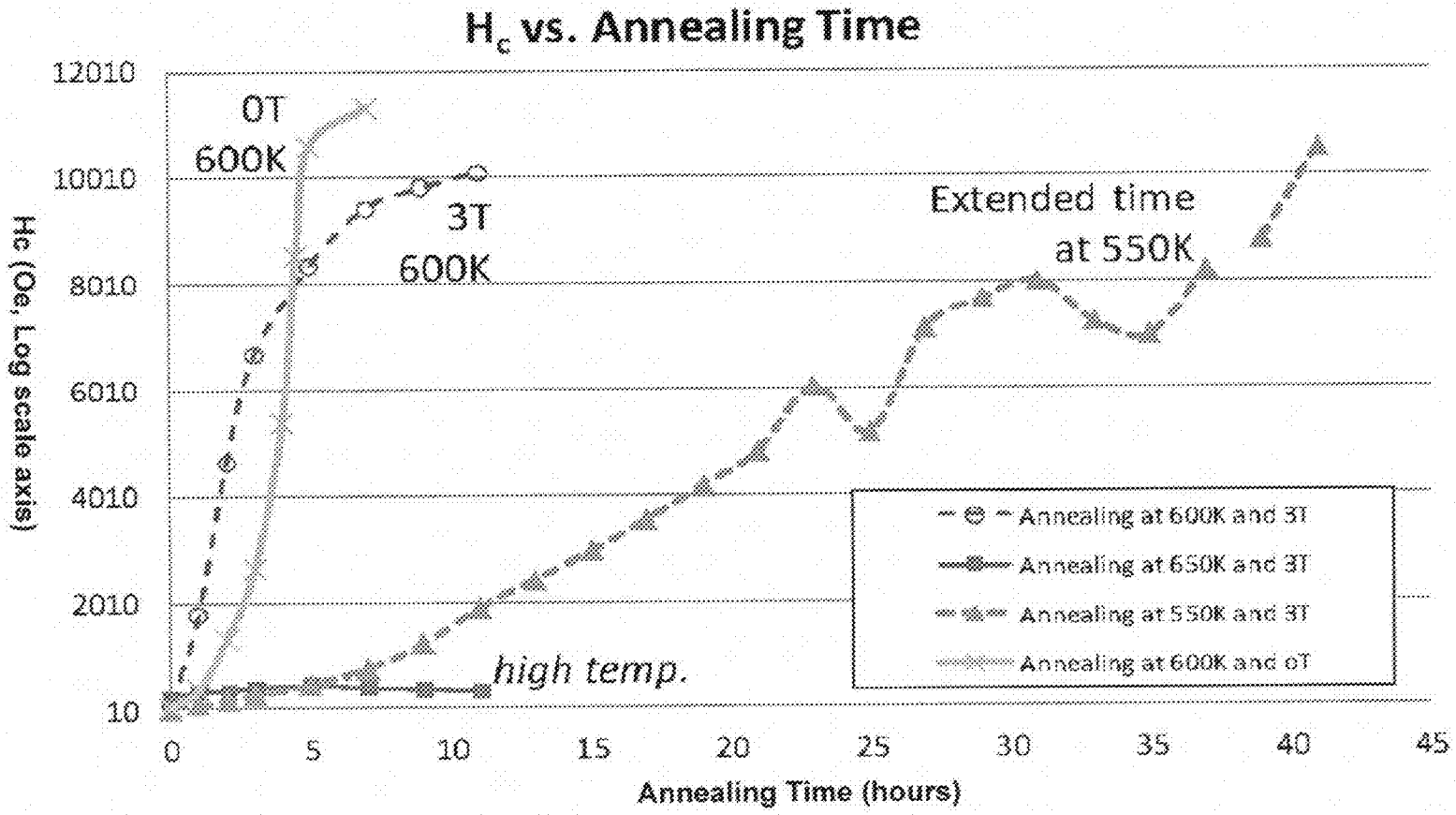
FIG. 4 shows the effect of annealing time and applied field on the $H_c$ value of the MnBi nanoparticles prepared in Example 1.

The annealing treatment may be conducted at a temperature of from 550 to 600K in a field having a coercivity of from 0 to 5 T. The annealing time will vary depending upon temperature and as indicated in the Examples requires approximately 11 hours at 600K and increases to approximately 40 hours at 550K (FIG. 4). Preferably, the annealing is conducted at 600K in a field of 3 T.

As shown in FIG. 4 annealing at 650K does not increase coercivity or magnetic saturation.

Figure 5B:
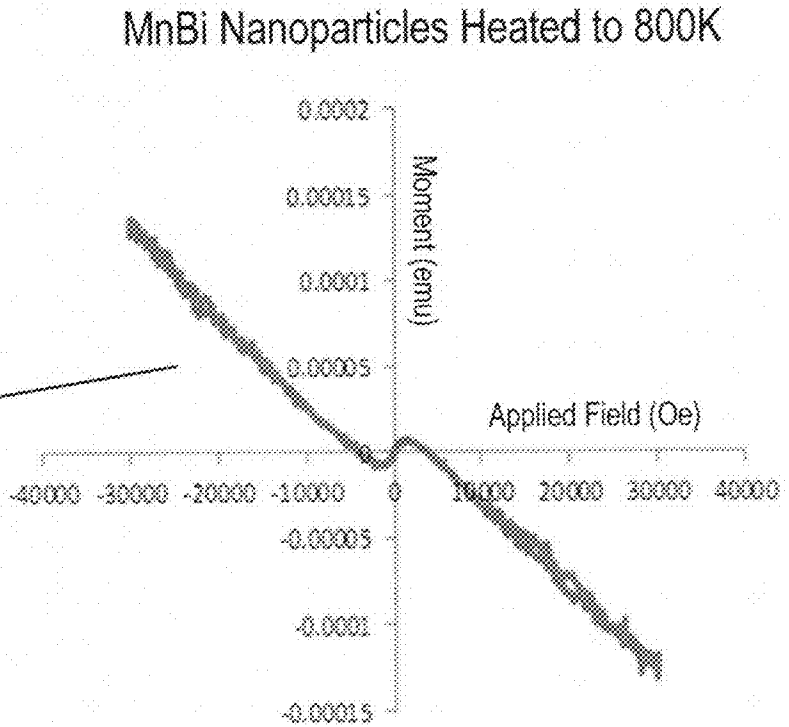
FIG. 5*b* shows the M(H) curve of the MnBi nanoparticles of Example 1 heated to form high temperature phase (listed as HTP in phase diagram).
Figure 5A:
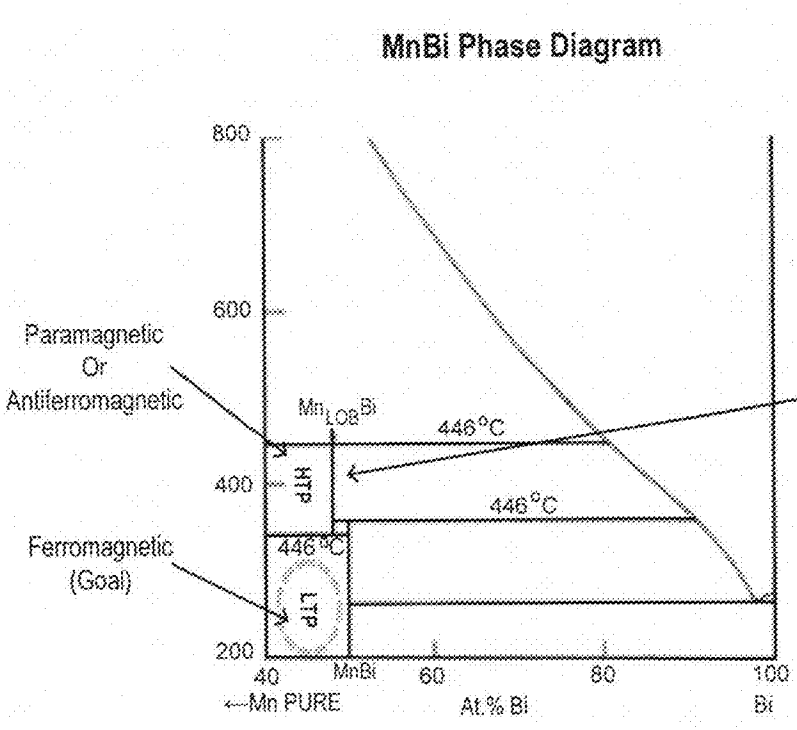
FIG. 5*a* shows the MnBi phase diagram.

Ferromagnetic MnBi is known to exist in what is referred to as the 'low temperature phase' region of the MnBi phase diagram (FIG. 5*a*). Above it exists what is referred to as the 'high temperature phase'. The high temperature phase is known to exhibit antiferromagnetic behavior.

The inventor has determined that when the wet synthesis MnBi nanoparticles are heated to temperatures of 800K the change from the ferromagnetic low temperature phase to antiferromagnetic high temperature phase takes place (FIG. 5*b*).

In an application embodiment, the present invention provides a hard magnet comprising a plurality of MnBi nanoparticles having a particle size of 5 to 200 nm and a coercivity of approximately 1 T. Preferably, the MnBi nanoparticles are obtained by a wet synthesis method according to the invention and the annealed at 600K in a 3 T field for at least 10 hours.

The above description provides a general overview and some preferred embodiments of the present invention. One of ordinary skill in the art will recognize that various permutations and modifications of the present invention are possible and these variations are considered within the scope of the present invention.

Having generally described the invention a further understanding of the invention may be obtained by consideration of the following Examples which are not intended to be limiting unless so specified.

EXAMPLES

Example 1. MnBi Nanoparticle Synthesis 200 mL of THF, 0.371 g Mn powder and 11.5 mL of 2 M $LiBH_4$/THF solution are combined. The reaction was first stirred at 23° C. for 24 hrs and then at 60° C. for an additional 24 hrs. To the resulting mixture was added a solution of 4.413 g bismuth neodecanoate dissolved in 200 mL THF. The bismuth neodecanoate solution was added slowly over 20 mins to the stirring Mn/$LiBH_4$ solution. After the bismuth neodecanoate addition was complete, 0.513 g octylamine were added to the product solution. The nanoparticles aggregated over the following 5 mins and were washed with water to remove reaction side products.

Characterization of the MnBi Nanoparticles

XRD Analysis

The XRD spectrum of the MnBi nanoparticles indicated the presence of three different crystalline materials present in the sample: MnBi alloy, Mn metal, and Bi metal (see FIG. 1). The MnBi nanoparticles were calculated to be approximately 30 nm in diameter based on peak width in this XRD spectrum.

FE-SEM Characterization

Figure 2B:
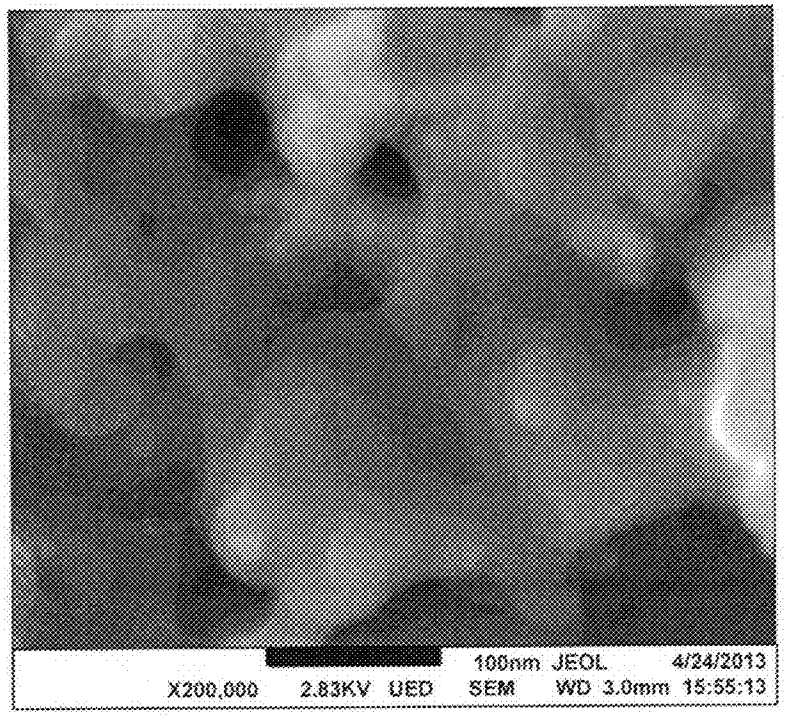
FIG. 2*b* shows the FE-SEM image (×200,000) of the MnBi nanoparticles prepared in Example 1.
Figure 2A:
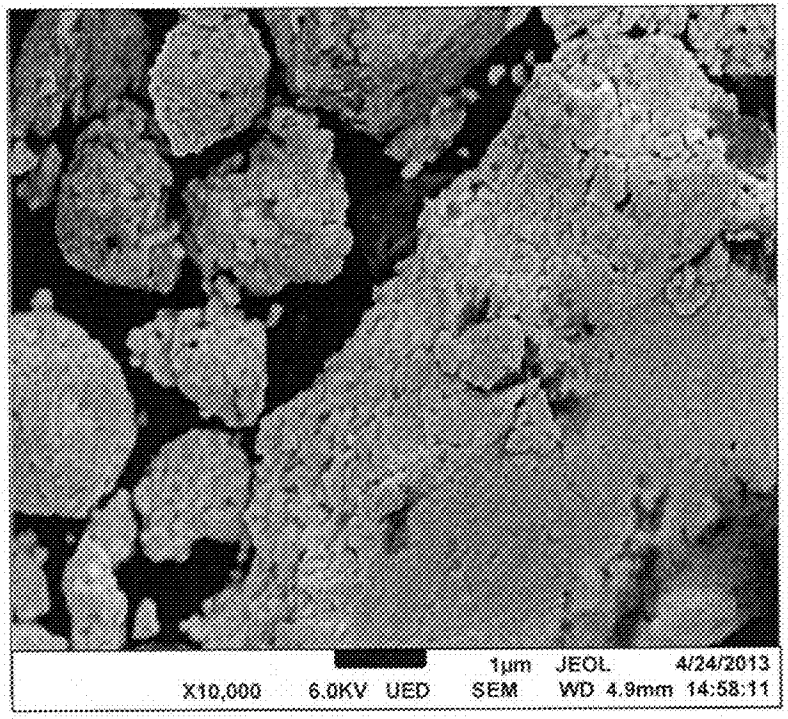
FIG. 2*a* shows the FE-SEM image (×10,000) of the MnBi nanoparticles prepared in Example 1.

High resolution FE-SEM microscopy was conducted on the nanoparticle powder product to further investigate the size of the wet synthesis product (FIGS. 2*a* and 2*b*). It was found that the sample was in fact composed of approximately 30 nm diameter features (on average) as indicated by analysis of the XRD spectrum. The FE-SEM data also indicated that 'large' micron-scale pieces of manganese were not present in the sample, also corroborated by the absence for very sharp peaks in the XRD spectrum. If the manganese powder was not being consumed in the synthesis, micron-scale pieces of manganese would be expected to be present in the XRD and FE-SEM data.

Example 2. Annealing Effects on MnBi Nanoparticles

The as-synthesized. MnBi nanoparticles were demonstrated on a very weak coercivity (<100 Oe). Samples of the nanoparticles were annealed in situ with aVSM oven attachment. It was initially found that annealing the nanoparticles at 600 K, in a 3 T field, produced improvement to both the magnetic saturation ($M_s$) and coercivity ($H_c$). Additionally, $M_r/M_s$ improved with this annealing protocol. $H_c$ values up to 1 T were measured, with an $M_r/M_s$ ratio of 45% (FIG. 3). $M_r/M_s$ is calculated by the division of $M_r$ by $M_s$ after the empirical measurement of the respective Values from synthesized material (e.g. MnBi). In FIG. 3 $M_r$ is the y-intercept and $M_s$ is the y-value associated with maximum x and y values in the $1^{st}$ quadrant of the graph.

Investigation at lower annealing temperature (550 K) showed that a similar 1 T $H_c$ could be reached, but that it required over 40 hrs of annealing, as opposed to ~11 hrs at 600 K (FIG. 4). Annealing the same batch of MnBi nanoparticles at 650 K gave very poor results, with a maximum $H_c$ of only approximately 500 Oe.

Ferromagnetic MnBi only exists in what is referred to as the 'low temperature phase' region of the MnBi phase diagram (FIG. 5*a*). Above it exists what is referred to as the 'high temperature phase'. The high temperature phase is known to exhibit antiferromagnetic behavior. A sample of MnBi nanoparticles was heated to 800 K to induce this change from the ferromagnetic low temperature phase to antiferromagnetic high temperature phase. The M(H) curve (FIG. 5*b*) is consistent with high temperature phase formation and further supports that alloyed MnBi nanoparticles are being made by the synthesis of Example 1.

The invention claimed is:

1. A MnBi nanoparticle having:

a particle size of 5 to 30 nm;

a $M_r/M_s$ ratio of from 25% to 45%; and a coercivity of approximately 1 T;

wherein the nanoparticle is prepared by a process, comprising:

treating Mn powder with a hydride reducing agent in an ether solvent with agitation;

adding a solution of a bismuth salt of a long chain carboxylate to the Mn-hydride reducing agent mixture while continuing the agitation;

upon completion of the bismuth salt solution addition, adding a an organic amine while continuing the agitation;

continuing agitation to form aggregated MnBi nanoparticles; and annealing the MnBi nanoparticles at 550 to 600K in a field of 3 T for from 3 to 40 hours to increase the $M_r/M_s$ ratio from a value less than 9% to a range from 25% to 45%.

2. The MnBi nanoparticle according to claim 1, wherein the annealment is at 600K in a 3 T field for from 3 hours to 11 hours.

3. A hard magnet comprising a plurality of MnBi nanoparticles according to claim 1.

* * * * *